US006829797B2

(12) United States Patent
Partian

(10) Patent No.: US 6,829,797 B2
(45) Date of Patent: Dec. 14, 2004

(54) CONTOUR AND TOPOGRAPHY ADJUSTING MASSAGING MATTRESS

(75) Inventor: Syrus Jacob Partian, 1703 Polo Lakes Dr. East, Wellington, FL (US) 33412

(73) Assignee: Syrus Jacob Partian

( * ) Notice: Subject to any disclaimer, the term of this patent is extended or adjusted under 35 U.S.C. 154(b) by 0 days.

(21) Appl. No.: 10/266,157

(22) Filed: Oct. 8, 2002

(65) Prior Publication Data

US 2004/0064896 A1 Apr. 8, 2004

(51) Int. Cl.[7] ..... A47C 27/10
(52) U.S. Cl. ..... 5/713; 5/710; 5/933
(58) Field of Search ..... 5/713, 710, 655.3, 5/644, 933

(56) References Cited

U.S. PATENT DOCUMENTS 6,073,290 A * 6/2000 Miller, Sr. ..... 5/710

* cited by examiner

*Primary Examiner*—Teri Pham Luu
*Assistant Examiner*—Fredrick Conley

(57) ABSTRACT

The contour and topography adjusting mattress distributes the weight equally over the entire contact surface, thus prevents morning sore spot formation and prevents decubitus wound formation in the prolonged bed-ridden patients. The massaging action of the mattress relieves muscular pain, relaxes the body, increases the blood circulation, also it further prevents sore spot and decubitus wound formation in the bed-ridden patients. It can be used in hospitals or at home.

1 Claim, 8 Drawing Sheets

CONTOUR AND TOPOGRAPHY ADJUSTING MASSAGING MATTRESS

BACKGROUND-DISCUSSION OF PRIOR ART

The prior arts are separately directed to methods for a massaging mattress, or increasing contour adjusting ability of a mattress. Review of the literature did not reveal any single mattress that offers both massage and adaptation to the shape or topography of a resting body. The topography and contour-adjusting quality of a mattress is the ability of the top layer of the mattress to mold to the contour and topography of the contact surface of a resting body. Numerous mattress designs and filling materials are employed to achieve these criteria. In a conventional mattress, segments of a flexible resting body sink into the mattress according to the weight they apply onto the mattress. For example the pelvis segment sinks into the mattress deeper than the waist segment because it is heavier. The difference in the depth of the sinking of the body segments due to the weight causes lateral curving of the spinal column. This results to stretching of some of the soft tissues such as: muscles, ligaments, joint capsules, and tendons. At the same time it causes compression of some of the joints associated with the spinal column. Due to the difference in the depth of sinking of the body segments, it is the resting body that has to adapt to the mattress surface, not vice versa. Compression and stretching of the tissues and joints during the resting time can result into the morning soreness and stiffness.

The ideal mattress is the one that maintains the natural alignment of the spinal column and distributes the weight of the resting body evenly over the entire contact surface of the mattress and the resting body. The present invention is designed to offer these unique features. The resting surface of the present mattress is composed of the plurality of discrete bases of hollow vertical columns. Under an applied pressure, each of these vertical columns can independently deform; thus the mattress can adjust to the contour and topography of the resting body. The pressure inside of vertical columns remains equal at all times, since the hollow spaces of the vertical columns are interconnected. Hence the upward pressure by the vertical columns unto the resting body will remain equal at all times. This means that the weight of a resting body will be equally divided over all the vertical columns that lie under it. This prevents decubitus wound formation in prolonged bed-rest patients. Optionally, the mattress can be designed to provide a massaging action. To achieve massaging action, pressure inside some of the vertical columns will be increases, at the same time the pressure inside another set (s) of the vertical columns will be decreased. Alteration of the pressure change in the vertical columns will provide the massaging action. These unique features of the present invention distinguish it from the previous ones. The following patents are found to be pertinent to the present invention:

MATTRESS ASSEMBLY FOR PREVENTION AND TREATMENT OF DECUBITUS ULCERS (John R. P; Michael N. Gold; Saadia M. Schorr, and Jack Gorby, U.S. Pat. No. 4,944,060, Filed Mar. 3, 1989) is a mattress with a base support, mattress core and a top layer. The top layer consists of a plurality of discrete air cells extending over the width of the mattress. The mattress is equipped with a controlling unit that regulates the pressure within individual cells or group of cells. The air cells in this mattress are extended over the width of the mattress; thus it is different from the present invention. Since the air cells are extended over the width of the mattress, it does not adapt to the contour and topography of the resting body in such an extent the present invention does, nor does the mattress provide the massaging action.

INTEGRATED MATRIX BEDDING SYSTEM (Robert D. Leventhal and Paul B. Thomas, U.S. Pat. No. 5,836,027, Filed Apr. 25, 1997) structurally is the closest mattress to the present invention. This mattress consists of two flexible top and bottom layers. The bottom layer consists of spaced-apart cylinders filled with air. The top layer is made up of foam that has vertical cavities in which the air cylinders of the bottom layer reside. The function of the vertical cavities of the top layer is to prevent lateral displacements of the air cylinders of the bottom layer. The resting surface of the mattress consists of a foam layer and the top surface of the air cylinders of the bottom layer. This mattress does not provide the massaging action either.

AUTOMATED PRESSURE RELIEF MATTRESS SUPPORT SYSTEM (John W. Wilkinson and Richard W. Rabum, U.S. Pat. No. 5,487,196, Filled Jan. 10, 1994) is an air mattress composed of a plurality of longitudinal air cells or air tubes that are connected to a pressurized air source. This mattress can be actively or passively activated to roll a patient from side to side. With regard to the contour and topography adjustment, this mattress shares feature with the invention of John R. P; Michael N. Gold; Saadia M. Schorr, and Jack Gorby, and does not offer massaging action.

METHODS AND APPARATUS FOR ALTERING PRESSURE OF A LOW AIR LOSS PATIENT SUPPORT SYSTEM (John H. Verzalik, U.S. Pat. No. 5,003,654, Filled Sep. 28, 1998) is a low air-loss mattress with two sets of rectangular air cells. The air cells are connected to a pressurized air source. By altering the air pressure in the sets of air bags, patient can be rolled from one side to the other side. Since the air cells are extended over the width of the mattress, this invention does not emphasize on the contour and topography adjustment as the present invention does. Also this invention does not provide massaging action.

AIR SUPPORT MATTRESS OVERLAY WITH FITTED SHEET MOUNTING (Miller, Sr. and Craig S., U.S. Pat. No. 5,745,941, Filed Feb. 13, 1997) is an inflated overlay that cab be placed on top of a mattress. The device has a base sheet that on the top has secured inflated elements extending over the width of the mattress. The overlay can be folded or rolled for transportation. This mattress differs from the present invention, since it does not adjust to the topography and contour of the resting body and does not offer massaging action either.

AIR MATTRESS FOR MODULATING RIDDEN POSITIONES (Wu; Shan-Chie), U.S. Pat. No. 5,966,762, Filed Jul. 1, 1998) is a mattress with a plurality of inflatable sacs extending to the width of the bed. These sacs are positioned in a mattress envelope. The sacs can be inflated or deflated for cushioning a patient. A plurality of the longitudinally positioned air cells is used to roll the patient from one side to other side. The longitudinally positioning of the air cells in this mattress is in contrast to the present invention in which the resting surface of the mattress is provided by the collection of bases of the air cells, hence these two inventions function in two different ways.

MASSAGING SYSTEM HAVING ISOLATED VIBRATORS (Sleichter C, U.S. Pat. No. 6,053,880, Filed Apr. 25, 2000) employs multiple motorized vibrators to provide massaging action in a vehicle seat. The disadvantages of using vibrators in a mattress include noise, vibration, and inability of the coverage of the entire resting surface.

MASSAGING MATTRESS (Chan H, U.S. Pat. No. 5,168,588, Filed Dec. 8, 1992) utilizes an elastic-stuffing material and a mattress covering. Wooden beads alternated with magnets are located between these two layers. The beads are connected via ropes to form a net. Rolling of the beads provides massaging action. Two major disadvantages are associated with this invention. First, the beads can not contact the pelvis segment and the waist segment with the same intensity due to lack of ability of the mattress to adjust to the topography of the resting body. Second, the movement of the beads will aggravate the sore spots of the body.

ROLLING-MASSAGING MATTRESS OR CUSHION (Chan H, U.S. Pat. No. 5,416,936, Filed May 23, 1995) introduced a layered mattress. Magnetic beads and balls are located between the top covering layer and the intermediate layer. Rolling of the balls and magnetic beads provides the massaging action. This invention contains the same disadvantages of the previous invention.

SUMMARY

The top surface of the mattress is composed of plurality of the bases of the hollow vertical columns. In a simpler design, the mattress does not provide the massaging action. In this case the mattress is composed of two layers: a top layer and a bottom layer. The top layer of the mattress comprising of an elastic-air and water impermeable material sealed to the bottom later. These two layers together form an air and water impermeable system. The top layer is composed of plurality of bases of closely packed hollow-elastic vertical columns with a low friction surface. The base of each hollow column has a polygon or cylindrical shape. Under applied pressure from a body each column can deform independently from the neighboring columns.

The bottom layer of the mattress is hollow and together with the top layer it forms an air/water sealed system. The inner hollow spaces of the top and bottom layers are connected that can be filled up with air, water, gel, or any other elastic material. The bottom layer can be made up of the same material as the top layer, or made up of a none-elastic material. From the open side, each hollow column is connected to the bottom layer. Therefore, air or other filling materials can freely move between two layers of the mattress. The contour adjusting quality of the mattress is achieved by deformation of the columns that are directly located under a resting body. The topography adjusting is achieved by the fact that the extent of the deformation in each column is directly proportional to the pressure it receives from the resting body.

With a different design the mattress can also offer massaging action on the resting body. Thus, the mattress is composed of plurality of longitudinally attached mattress units. Each mattress unit is composed of one elastic-hollow rectangular prism and multiple elastic-hollow vertical columns. As in the other design explained above, the outer surface of the vertical columns is made up of a low friction material to prevent noise and decrease friction. The vertical columns are attached to one longitudinal side of the prism. In a mattress unit the hollow spaces of the vertical columns are connected with the hollow space of the rectangular prism, forming a single hollow space of the mattress unit. The rectangular prism is open on one end, forming the opening of the mattress unit. The mattress units are longitudinally connected side by side in such a way that all the vertical columns are placed on the topside of the mattress. Therefore, the top surface of the mattress is composed of the plurality of the discrete bases of the vertical columns. The mattress units are divided into two or more sets in such a way that no two adjacent mattress units belong to the same unit set. By simultaneous increasing pressure in one unit set and at the same time decreasing pressure in the adjacent unit set(s), the mattress applies upward massaging action onto the resting body. Each column can be compressed independently; this maximizes the ability of the mattress to adapt to the shape and topography of the resting body. The hollow spaces of all vertical columns are interconnected, therefore the internal pressure in the vertical columns remain equal at all time. That means the weight of the resting body will be distributed equally between all vertical columns located under the resting body. This prevents bed sore spots and decubitus wound formation in a prolonged bed-rest patient.

BRIEF DESCRIPTION OF THE SEVERAL VIEWS OF THE DRAWINGS

In the drawings, closely related figures have the same number but different alphabetic suffixes; also components of each piece have the same number but different alphabetic suffixes.

Figure 1:
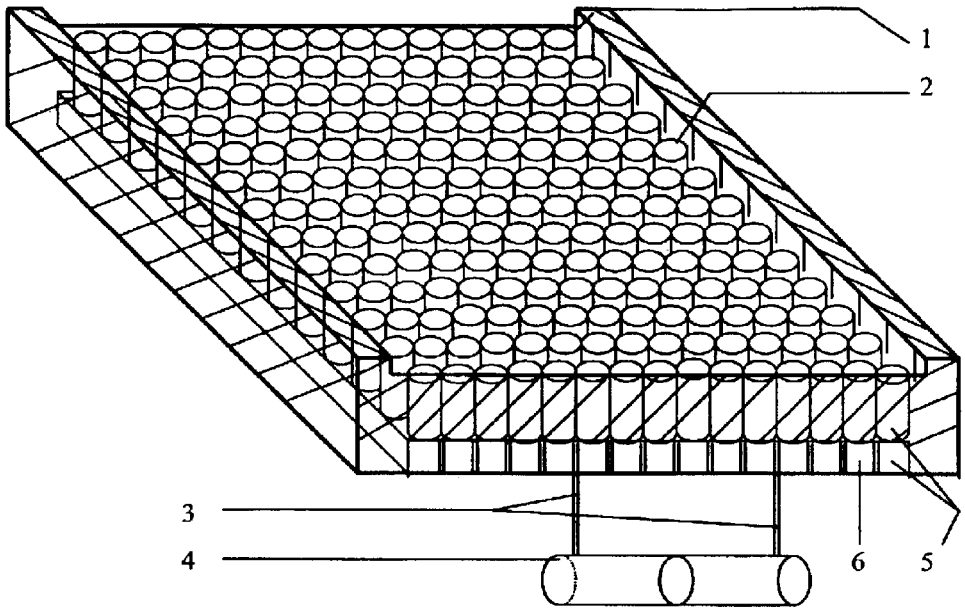
FIG. 1 shows the 3-dimensional view of the contour and topography adjusting-massaging mattress.

REFERENCE NUMERALS IN DRAWINGS (1) edge
(2) vertical column
(3) connectors
(4) pressure regulator
(5) mattress unit
(6) chamber
(7) closed base
(8) open base
(9) opening
(10) opening
(11) unit set
(12) unit set
(13) space
(14) space
(15) piston
(16) resting body
(17) mattress
(18) top layer
(19) bottom layer

DETAILED DESCRIPTION OF THE INVENTION

The 3-dimentional view of the mattress is shown in FIG. 1. The upper surface of the mattress consists of a plurality of discrete bases of the hollow vertical column (2). The mattress is equipped with an optional soft edge (1) for protection. A pressure regulator (4) is placed under the mattress. It changes the pressure inside the unit sets for the massaging action. Two connectors (3) that connect the contents of the hollow space of the mattress units and pressure regulator (4) are shown as well in this figure. Multiple longitudinal chambers (6) can be seen in FIG. 1 also. Mattress unit (5) is composed of one chamber (6) of the bottom layer and multiple vertical column (2) of the top layer. The number of mattress unit (5) in a mattress depends on the size of the mattress.

Figure 2:
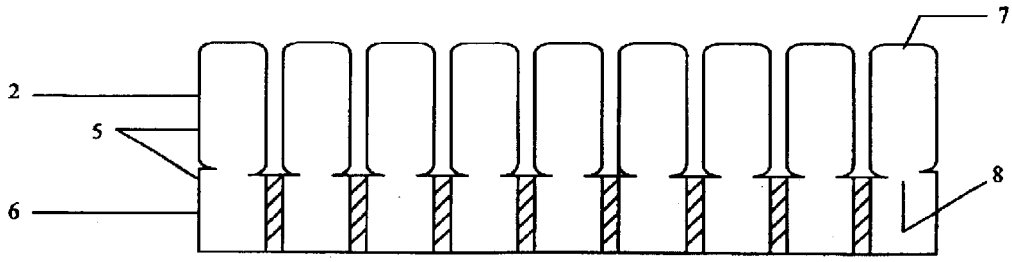
FIG. 2 shows the frontal cross section of the massaging mattress.

FIG. 2 shows the frontal cross section of several vertical column (2) and chamber (6). It can be seen that under applied pressure the elastic filling material of the mattress can freely travel in and out of vertical column (2), thus altering the height of the vertical columns.

Figure 3:
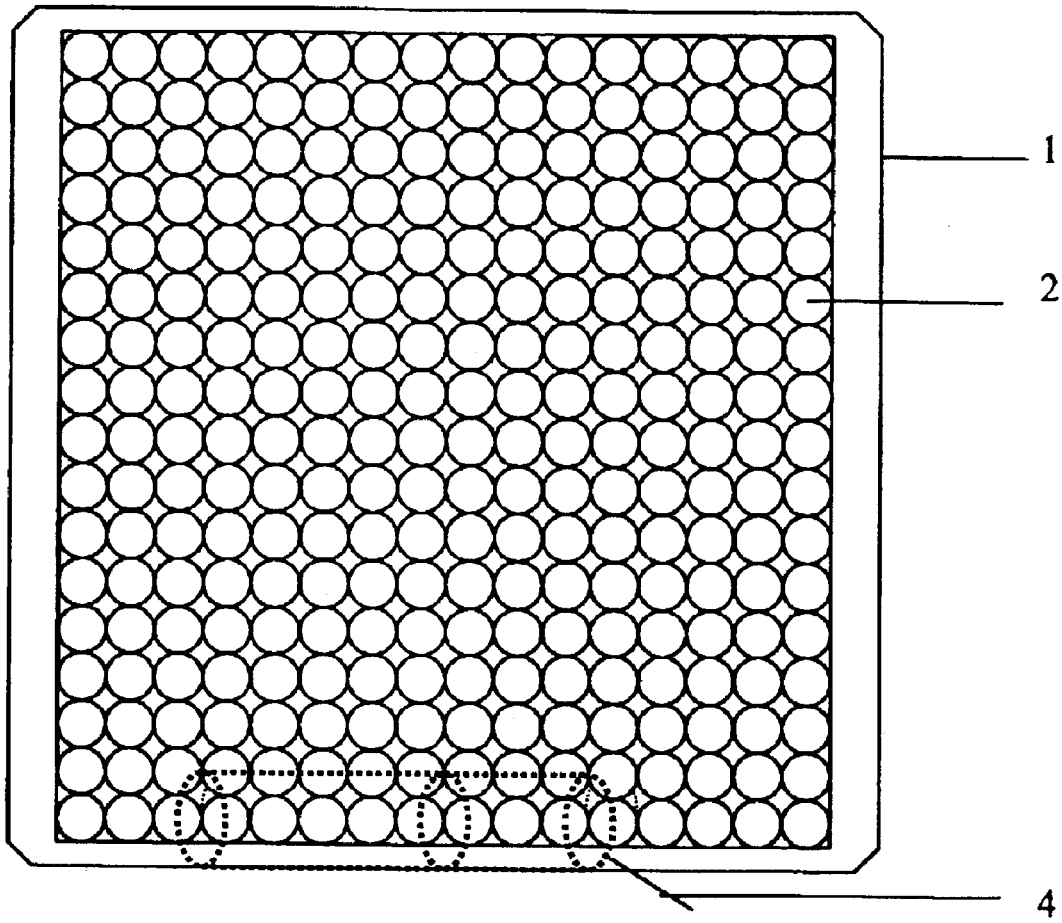
FIG. 3 shows the top view of the mattress.

The top view of the mattress is shown in FIG. 3. Mattress edge (1) and vertical column (2) can be seen readily. Pressure regulator (4) is placed under the bed.

Figure 4:
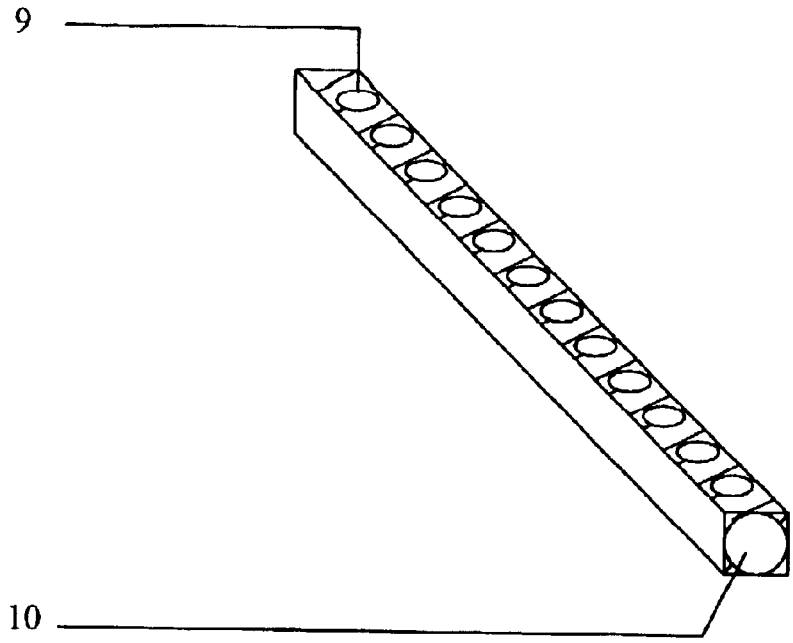
FIG. 4 shows one chamber of the bottom layer of the mattress.

The structural of one chamber (6) is shown in FIG. 4. The chamber has multiple opening (9) on one longitudinal side that vertical column (2) of the top layer will locate on them. Each chamber (6) also has an opening on one base (9) through which it connects to other chambers and the pressure regulator.

Figure 5:
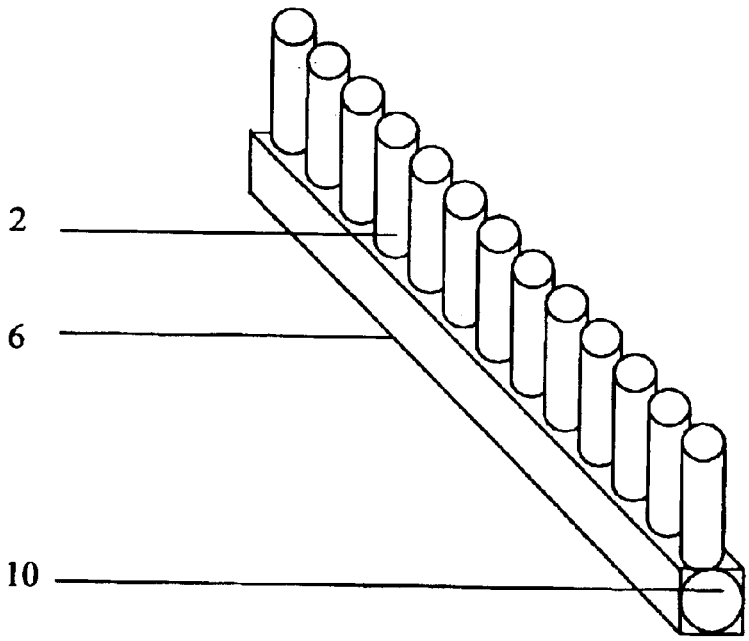
FIG. 5 shows the structure of one mattress unit.

FIG. 5 shows the structure of mattress unit (5). It consists of multiple vertical column (2) of the top layer and one chamber (6) of the bottom layer. Opening (10) is for connection between internal contents of mattress unit (5) and pressure regulator (4).

Figure 6:
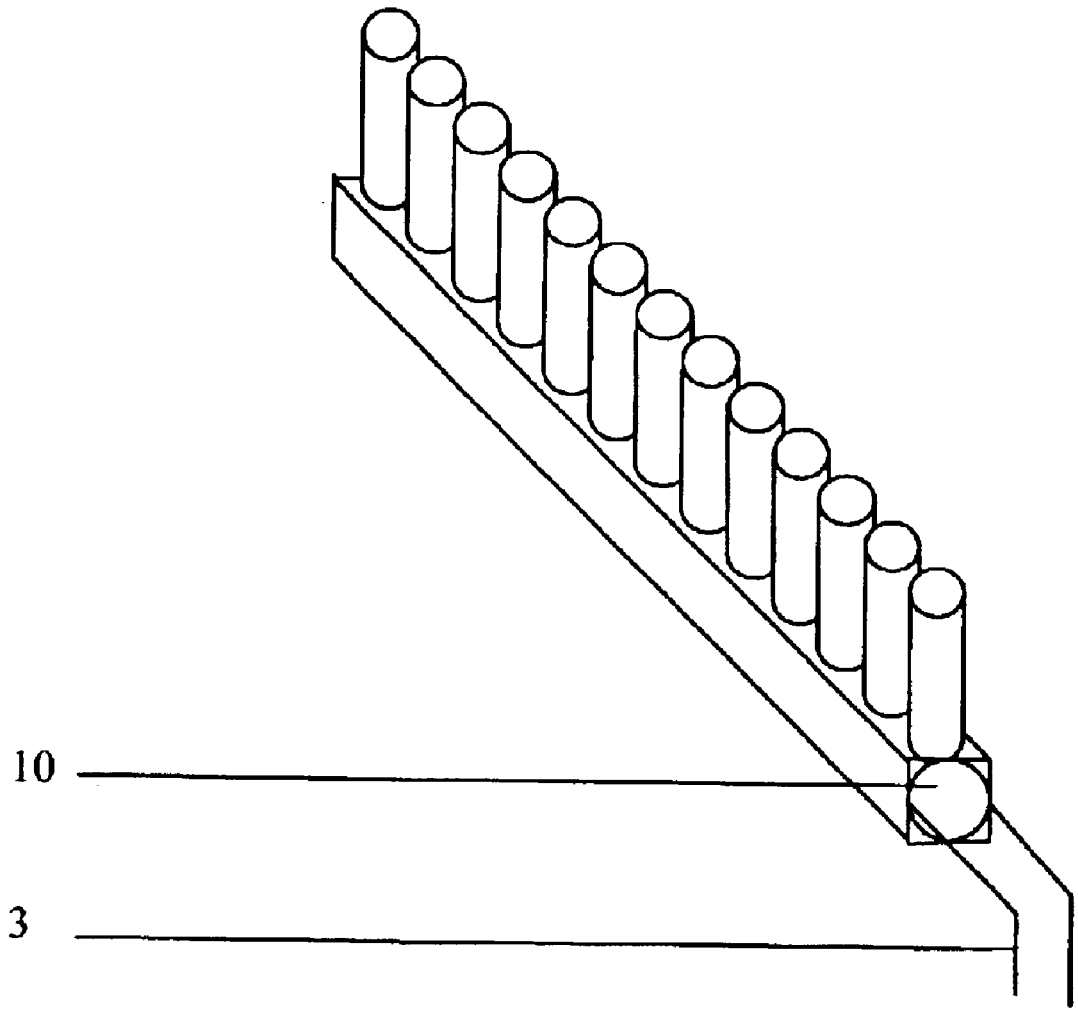
FIG. 6 shows the mattress unit and the connector.

FIG. 6 shows the position of connector (3) with regard to mattress unit (5).

Figure 7:
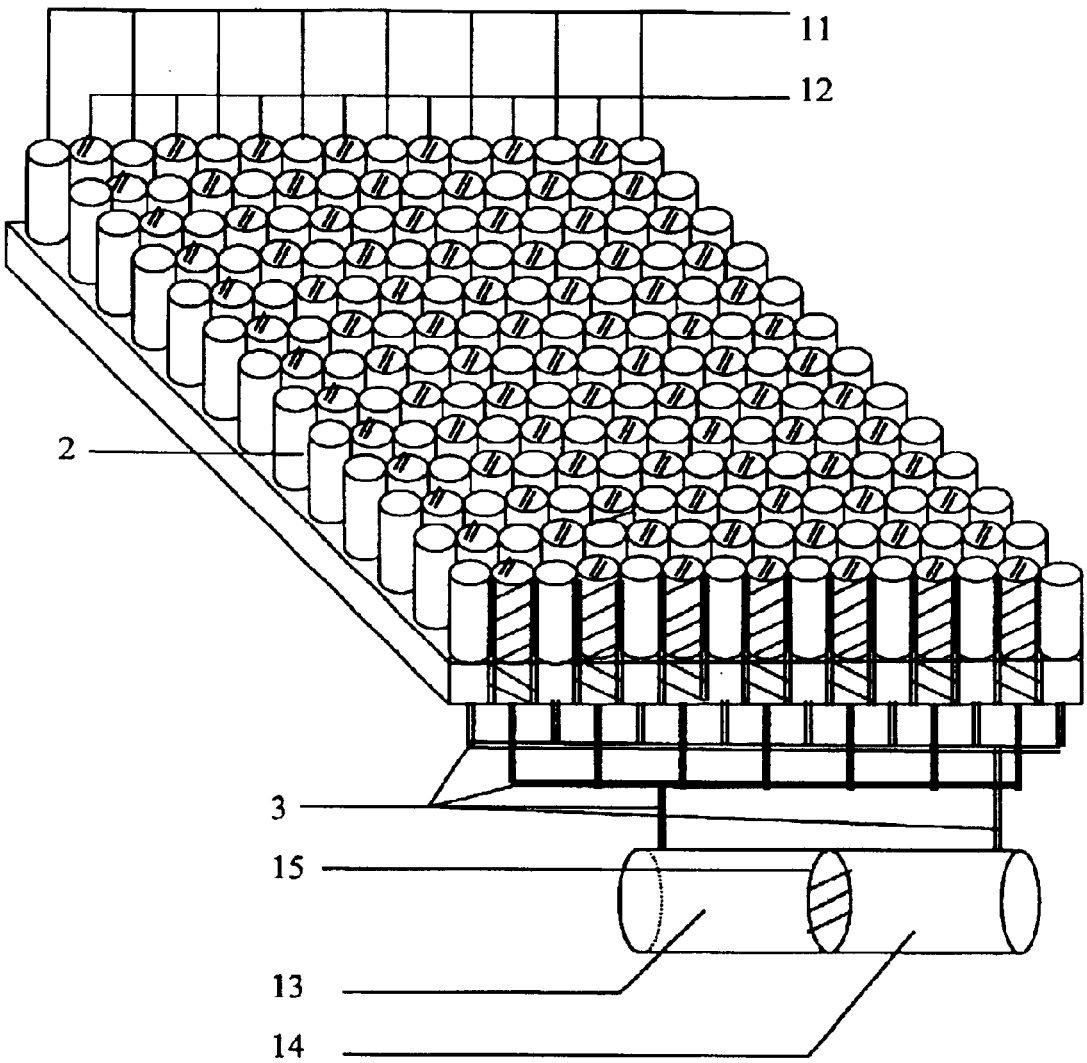
FIG. 7 shows the connection between the pressure regulator and two unit sets.

FIG. 7 shows 3-dimentional view of the mattress without mattress edge (1). FIG. 7 emphasizes on unit set (11) and unit set (12). Mattress units (5) are divided into sets in such a way that no two adjacent mattress units (5) belong to the same mattress unit set. The present drawings show only two unit sets (11) and (12). Non of the mattress unit (5) in a unit set are in immediate vicinity. This is important in the massaging action of the mattress that will be explained later. In FIG. 7 two unit sets are marked; one dashed (12) and another other one not dashed (11). Connector (3) connects unit set (12) to the left pressure chamber (13) and unit set (11) to the right pressure chamber (15) of pressure regulator (4). Inside pressure regulator (4) two pressure chambers (13) and (14) are separated via piston (15). Piston (15) can freely move to the right or to the left altering the volumes of (13) and (14).

Figure 8:
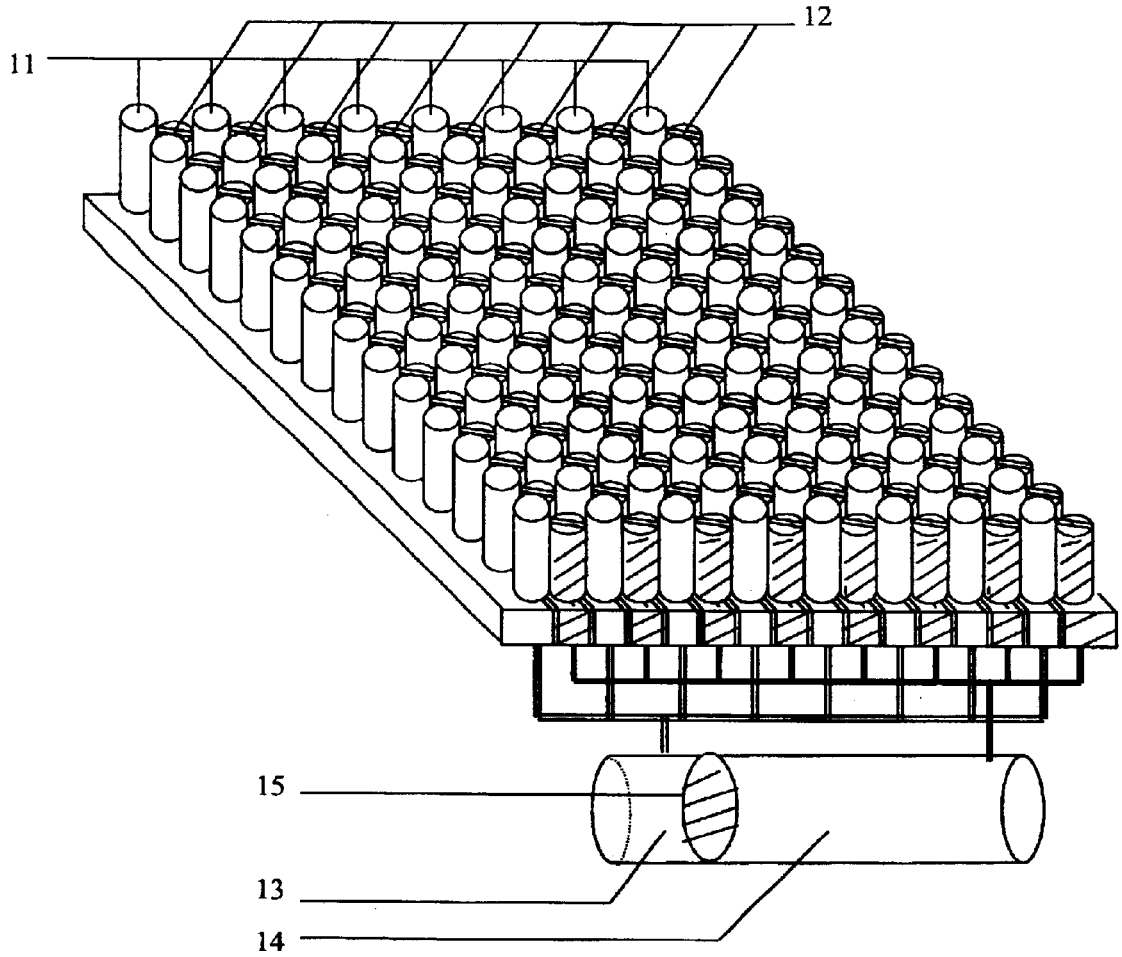
FIG. 8 shows the effect of simultaneous increased pressure in one unit set and decreased pressure in the other unit set of the mattress.

FIG. 8 shows the 3-dimentional view of the mattress without mattress edge (1). Piston (15) has moved to the left, hence increased the volume of pressure chamber (14) and decreased the pressure inside unit set (12). At the same time it has decreased volume of pressure chamber (13) and has increased pressure inside unit set (11). Alternative movements of piston (15) to the left and to the right will alter the pressure inside unit sets (11) and (12), thus producing the massaging action on a resting body.

Figure 9:
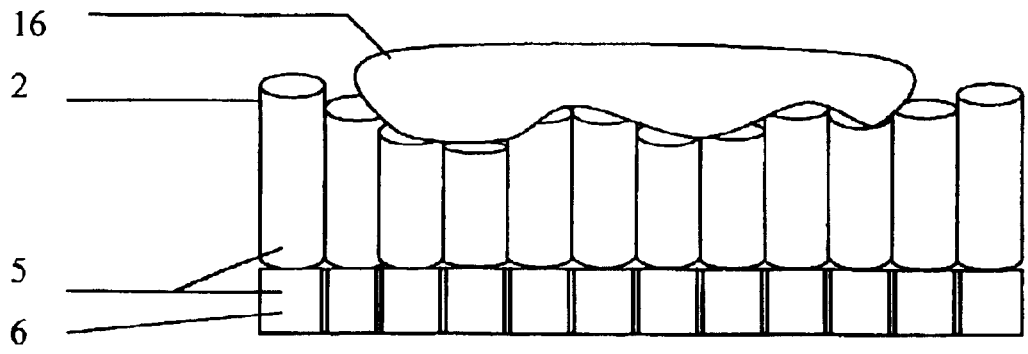
FIG. 9 shows a frontal cross section of the mattress under a resting body.

FIG. 9 shows the frontal cross-section view of the mattress without mattress edge (1). The cross sections of 12-mattress units (5) are shown in this figure. Also FIG. 9. shows how the mattress reacts under an uneven pressure and an even topography of a resting body (16). As can be seen, the extent of deformity in each vertical column (2) depends to the pressure it receives from the above. This action of the mattress preserves the natural alignment of the spinal column of a resting body. Since the hollow spaces of all vertical columns are connected, the elastic filling material can freely move in and out of vertical columns (2). Consequently, the pressure remains equal inside all of vertical columns (2) at all times. This means that the pressure of resting body (16) will be equally divided over the entire vertical columns (2) that are under the resting body. This prevents sore spot formation in the morning and decubitus wound formation in the prolonged bed ridden patients in the nursing homes and in the hospitals.

Figure 10:
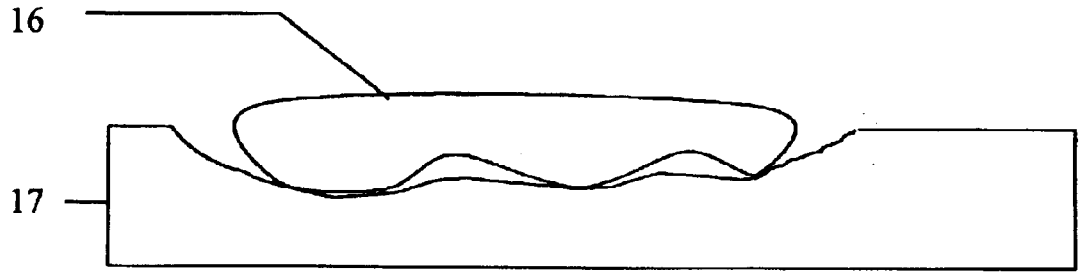
FIG. 10 shows the frontal cross section of a conventional mattress under a resting body.

FIG. 10 shows the reaction of a conventional mattress (17) under resting body (16). In this case because the top layer of the mattress is formed from a single surface, under the weight of resting body (16) the entire top surface of the mattress will deform. Therefore the mattress can not effectively mold to the topography of the resting body. Therefore the weight of the resting body will not be distributed equally over the contact surface, and the mattress will not apply an equal upward pressure on all contact points. As a result, resting body (16) will loose its natural-spinal alignment and can develop sore spots formation form the excess pressure on the heavier parts of the body such as pelvis segment.

Figure 11:
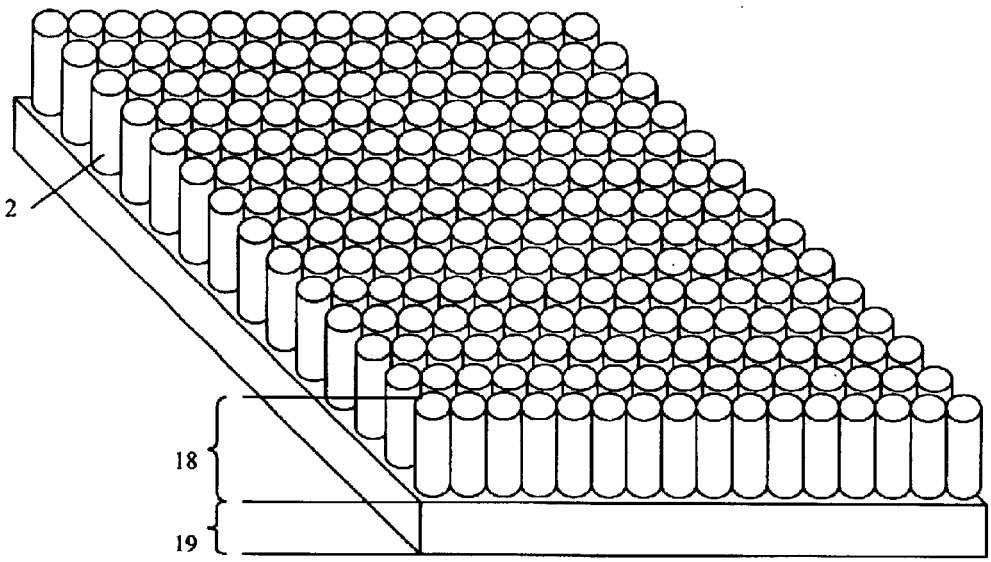
FIG. 11 shows three-dimensional view of a contour and topography adjusting mattress with no massaging capability.

FIG. 11 shows three-dimensional view of non-massaging version of this mattress. This mattress is composed of two hollow layers, the top layer and the bottom layer. The top layer is formed by proximity of the hollow vertical columns. Vertical column (2) is open on the side it is connected to the bottom layer. In this design the mattress offers all features as were mentioned so far, except the massaging action.

Figure 12:
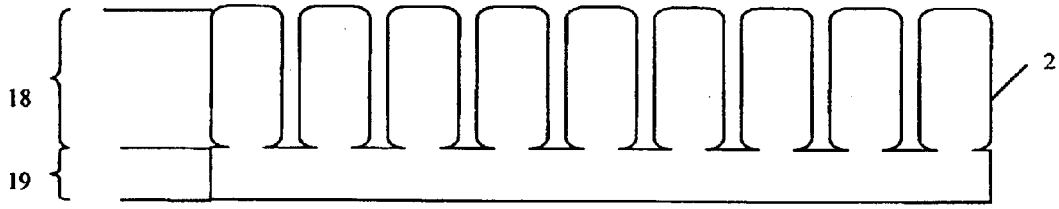
FIG. 12 shows the frontal cross section of the contour and topography adjusting-mattress with no massaging capability.

FIG. 12 shows the frontal cross section of the non-massaging mattress.

From the above description, the advantages of my invention become evident.

(a) The top layer of the mattress is composed of plurality of bases of numerous elastic columns (2) with small cross sections. Under resting body (16) each column independently compresses proportional to the pressure it receives. Consequently, the top layer of the mattress adapts to the topography and contour of the contact surface of a resting body far superior than any other product in the market.

(b) Alteration of increasing pressure inside one unit set, for example (12) and at the same time decreasing pressure in the other unit set, here (13), will have a massaging action on resting body (16). Since the closed upper base of vertical column (2) is small, the massage will be applied over the entire contact surface of resting body (16). This can be very valuable for patients that have difficulty to change their body positions. It can also be used at home to relief muscular soreness.

(c) Since the inner hollow spaces of all vertical columns are connected, the upward pressure from every vertical column onto resting body (16) is equal at all times. That means that the weight of the resting body will be distributed equally over the entire contact surface. This in conjunction with the massaging action of the mattress prevents sore spot and decubitus wound formation in prolonged bed ridden patients.

(d) This mattress can be included in the structure of another mattresses. In this case, it can be constructed as the top layer of a mattress; or can be used independently as a mattress.

(e) The filling medium can be air, water, gel, or any elastic material that can flow in and out of vertical columns.

(f) The columns can be cylindrical or a polygon in cross section.

(g) The size and the shape of this mattress can be customized according to the application. Thus it can be shaped into a pillow, back support, or other supporting surfaces.

(h) To fit different budgets, the mattress can be designed with or without massaging action. Non massaging design is simple, it consists of a top layer of vertical column (2) and a hollow bottom layer. This design offers all others features of the massaging design.

The above descriptions contain many specificities and options that make this mattress to be useful in different settings.

Numerous variations and options can be made available depending on the application. Based on the budget and application, the mattress can offer the massaging action. The filling material can be air, gel, fluid, or an elastic material. The sides of the mattress can be equipped with foam, air tubes or other supporting means to provide more protection during the resting time.

The scope of this invention should be determined by the appended claims and their legal equivalents, rather than by the examples given.

I claim:

1. A mattress consisting of:

(a) a toy layer having a plurality of closely-packed-low friction-elastic-hollow vertical columns, (b) each vertical column has an open base facing a bottom layer of the mattress and a closed base that forms the resting surface of the mattress, (c) the vertical columns are arranged into rows, the rows are divided into two row sets in such a way that no two immediate neighboring rows belong to the same row set, (d) the bottom layer of the mattress consists of a plurality of elongated air chambers each located under one row of the vertical columns of the top layer forming a mattress unit, each mattress unit is connected to other mattress units corresponding to the same row set, each mattress unit set is connected to a pressure chamber, together forming one air-tight pressure unit wherein a change of the volume in the pressure units results into the massaging action of the mattress onto a resting body.

* * * * *